US009283435B2

(12) United States Patent
Kessler

(10) Patent No.: US 9,283,435 B2
(45) Date of Patent: Mar. 15, 2016

(54) WIGGLY WAGGLY FUN NOODLE

(71) Applicant: MAUI TOYS, INC, West Los Angeles, CA (US)

(72) Inventor: Brian Kessler, West Los Angeles, CA (US)

(73) Assignee: MAUI TOYS, INC., Santa Monica, CA (US)

( * ) Notice: Subject to any disclaimer, the term of this patent is extended or adjusted under 35 U.S.C. 154(b) by 0 days.

(21) Appl. No.: 14/260,500

(22) Filed: Apr. 24, 2014

(65) Prior Publication Data

US 2014/0323000 A1 Oct. 30, 2014

Related U.S. Application Data

(60) Provisional application No. 61/816,362, filed on Apr. 26, 2013.

(51) Int. Cl.
*B63C 9/08* (2006.01)
*A63B 31/00* (2006.01)
*A63H 23/10* (2006.01)
*A63H 33/18* (2006.01)

(52) U.S. Cl.
CPC ..... *A63B 31/00* (2013.01); *A63H 23/10* (2013.01); *A63H 33/18* (2013.01)

(58) Field of Classification Search
USPC ..... 441/129
IPC ..... B63B 35/74; A63B 31/00,23/10
See application file for complete search history.

(56) References Cited

U.S. PATENT DOCUMENTS

| | | | | |
|---|---|---|---|---|
| 4,076,189 | A * | 2/1978 | Powell | 244/153 R |
| 6,843,695 | B1 * | 1/2005 | Jackson et al. | 441/129 |
| 2005/0225858 | A1 * | 10/2005 | Dobihal et al. | 359/515 |
| 2014/0099855 | A1 * | 4/2014 | Liberatore | 446/153 |

* cited by examiner

*Primary Examiner* — Stephen Avila
(74) *Attorney, Agent, or Firm* — Browdy and Neimark, PLLC

(57) ABSTRACT

Fun "noodles," elongated flexible tubes formed of closed-cellular foam plastic used for play in water, are provided with decorative wiggly waggly tails at their ends, the tails being capable of new play patterns and water splashing effects.

7 Claims, 3 Drawing Sheets

WIGGLY WAGGLY FUN NOODLE

FIELD OF INVENTION

The present invention relates to so-called "noodles" used for support and play particularly in water.

BACKGROUND OF INVENTION

Such "noodles" are elongated flexible tubes formed of closed-cellular foam plastic used for play in water, e.g. swimming pools. Because of the closed cellular foam construction, these "noodles" float and can be used for support in the water. In general, these "noodles" are formed of closed cell polyethylene terephthalate (PET) or polyethylene foam in tube shapes, commonly used as a toy in swimming pools and for types of water-oriented play. In general, these known "noodles" are tubular, i.e., they have an axial opening extending entirely therethrough, with the exterior being shaped in cross section as a circle, a star or a flower.

SUMMARY OF INVENTION

In accordance with the present invention, "noodles" of the type described above are modified in the present invention by adding "wiggly tails" to one or preferably each end of the noodle, thus providing a "noodle" capable of new play patterns and a water splashing effect at a relatively low cost.

DETAILED DESCRIPTION

Figure 1:
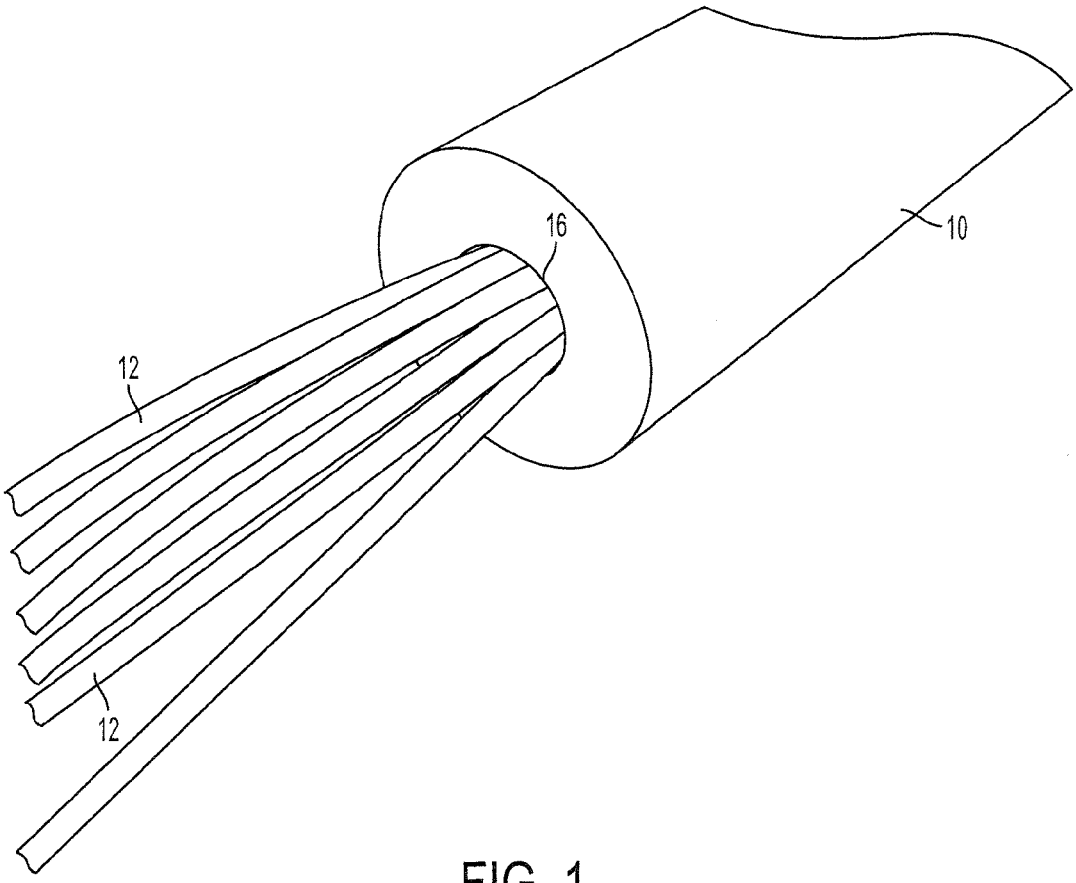
FIG. 1 is a perspective view of one end of a cylindrical noodle in accordance with the present invention.
Figure 2:
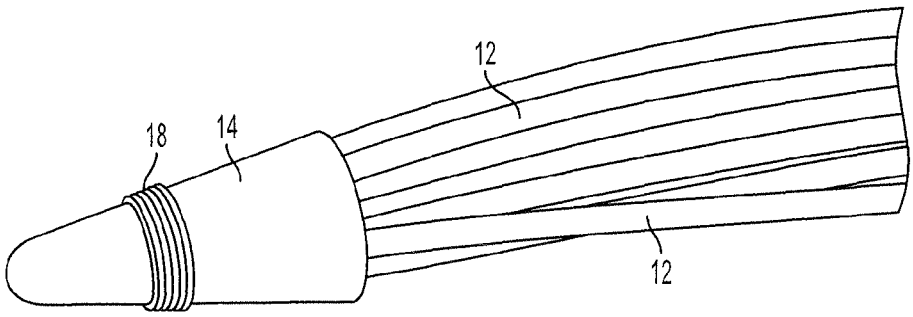
FIG. 2 is a perspective view of a stopper adapted for insertion in an end of the "noodle," the stopper having the wiggly tails extending therefrom.

With reference to FIG. 1, one end of a cylindrical noodle 10 is shown having a plurality, e.g. 8 to 16, of wiggly tails or streamers 12 extending therefrom. FIG. 2 shows a stopper 14 from which project the wiggly tails 12. Such wiggly tails 12 are anchored within the stopper 14, and the stopper 14 is then tightly fit within the axial opening 16 of the noodle 10, it being understood that a stopper 14 and the wiggly tails 12 are desirably provided at each end of the noodle 10.

As indicated above, the noodle 10, by itself, may be conventional, i.e. in cross section it may take the form of a circle as shown in FIG. 1 or may take the form of a flower, a star, etc, wherein practically any exterior configuration is permissible. The noodle is formed of a closed cellular foam, desirably PET or polyethylene, although other preferably soft and flexible plastics can be used. And, for use in water, the noodle must be capable of floating, i.e. have a density less than water due at least to the closed cellular nature of the plastic.

The wiggly tails 12 are desirably tubes or strips formed of a soft extruded polymer such as soft PVC, polyurethane or silicone rubber and these wiggly tails 12 are highly flexible. When the wiggly tails are dipped or splashed in and out of water, they tend to capture small water droplets and create exciting rain splashing effects and patterns. Such wiggly tails 12 are desirably extruded in different colors (e.g. orange, pink, yellow, blue, purple, etc). The wiggly tails also may be of different lengths.

The stopper 14 is desirably removable, and may have screw threads 18 which serve to both lock the stopper 14 within the hollow end 16 of the noodle 10, and also permit is unscrewing therefrom. As illustrated, the stopper 14 is desirably at least slightly tapered to facilitate insertion into the open ends of the noodle 16. It will be understood that the maximum diameter of the stopper 14 is approximately the same as the diameter of the hollow center 16 of the noodle 10, but with the screw thread 18 being slightly greater than the diameter of the hollow center of the noodle 10, so that the screw thread can tap a receiving female screw thread into the interior wall of the hollow center 16 of the noodle, as the stopper 14 is screwed in.

Figure 3:
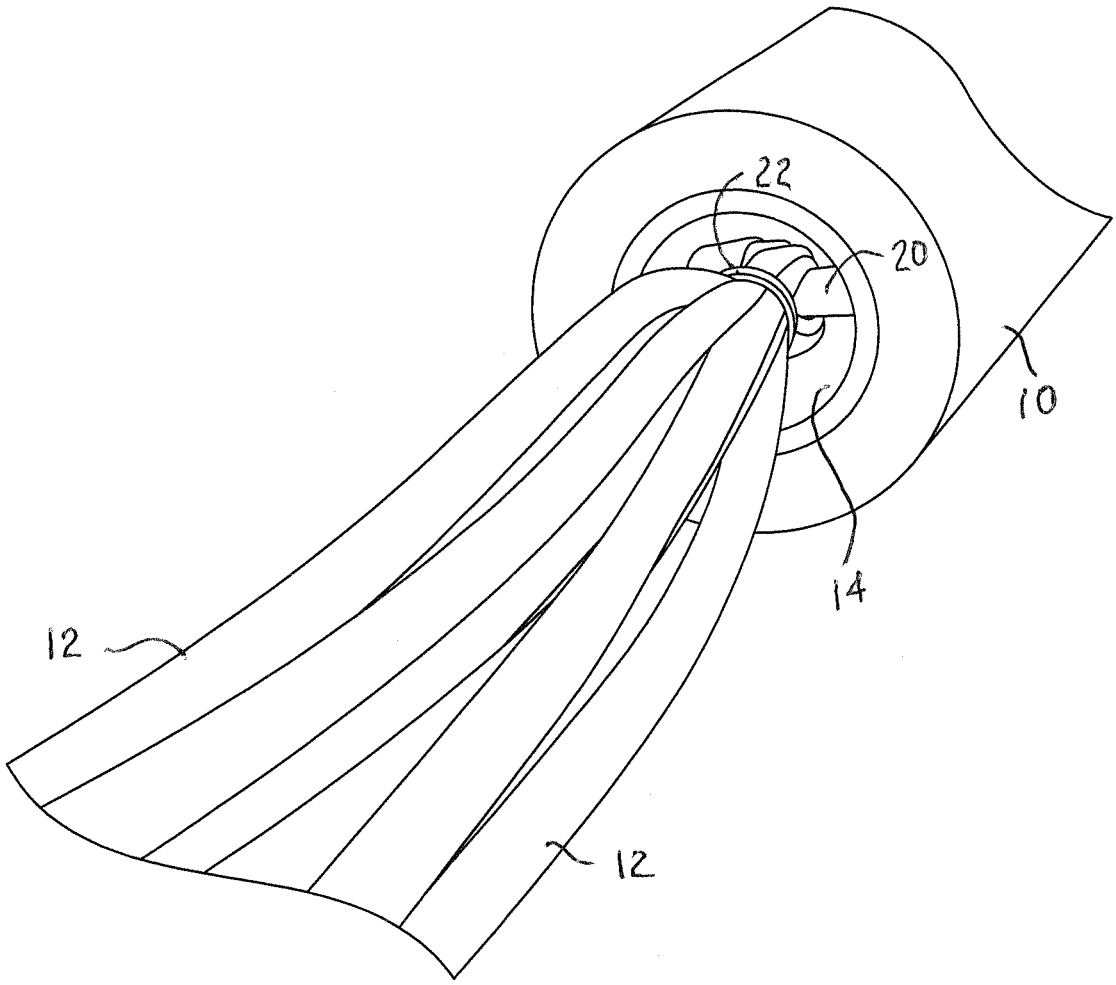
FIG. 3 is a partially broken away perspective view showing the wiggly tails protruding from the stopper.

The wiggly tails 12 are attached to the stopper 14, for example as shown in FIG. 3, or alternatively may simply be tightly inserted into the hollow end of the stopper 14 to be held by friction or with a suitable water resistant, flexible adhesive, e.g. an adhesive silicone resin. In such a case, the individual wiggly tails 12 are bunched up and glued, pressed into or more desirably inserted into a hollow (not shown) in the upstream end of the stopper plug 14. The individual wiggly tails 12 are bunched up and glued, pressed into, and/or crimped or pinched into place within the upstream end of the stopper plug 14.

The plug 14 is appropriately molded of a plastic, such as by rotational casting, injection molding or blow molding. The stopper plugs 14 are desirably of PVC or a similar plastic, or a soft semi-flexible material such as rubber or a polyurethane based polymer, but must be made sufficiently rigid so as to be able to screwed into and out of the ends of the noodle 10 without collapsing, and have sufficient rigidity to not collapse under pressure from the water. One particularly preferred form of the plug 14 is shown in FIG. 4 and is made of two longitudinally extended halves which are joined together by interfitting and interlocking extensions 20A and 20B which, for at least one of these interlocking elements 20, provides a post about which the wiggly tails 12 are wrapped as shown in FIG. 3.

Figure 4:
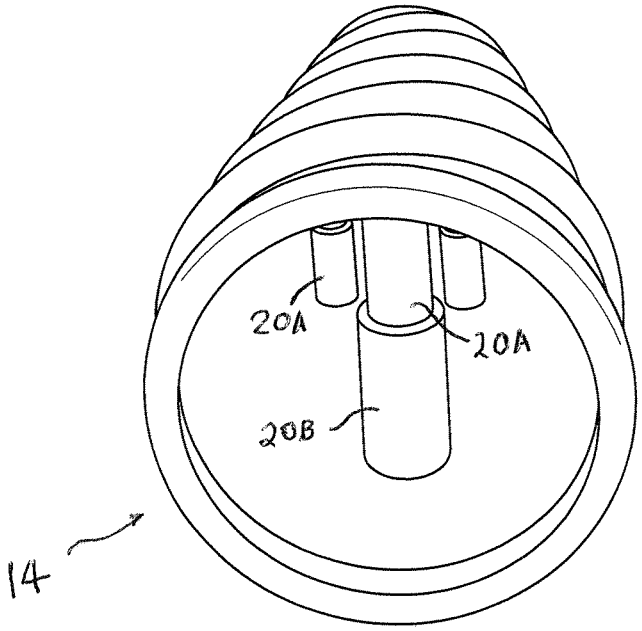
FIG. 4 is a perspective view of a suitable stopper for use as part of the present invention.

The two piece plug 14 as shown in FIG. 4 is desirable in that it facilitates attachment of the wiggly tails 12. As shown in FIG. 3, the tails 12 can be wrapped around the post 20B prior to joining the second half of the plug 14 to the first half having the post 20B, followed by joining the two halves as shown in FIG. 4, but with the wiggly tails 12 having been already attached. To better hold the wiggly tails 12 on the post 20, a simple wire wrap 22 is desirably used, although other means such as adhesive can instead be used.

Although the stopper 14 could be eliminated by simply gluing the wiggly tails 12 within the hollow 16 of the noodle 10, the stopper plug 14 provides advantages. Thus, use of the stopper plug 14, desirably at both ends of the noodle 10, permits removal and replacement of the wiggly tails 12. The plug 14 also prevents water from entering the interior of the noodle 10. In addition, use of the plug 14 permits a more reliable attachment of the wiggly tails 12 to the ends of the noodle 10.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. The combination of a foam plastic noodle and wiggly tails extending from at least one end of the noodle, the combination comprising:

a closed cellular foam noodle having an axial bore at one end at least thereof, a first removable holder secured and seated in the axial bore at the end of the noodle, a second removable holder extending from a second end of the noodle, the first and second removable holders forming plugs closing the first and second ends, respectively, and a plurality of flexible strands or tails connected to and extending from the first and second holders secured and seated in the first and second ends, respectively, of the noodle.

2. The combination of claim 1, wherein said axial bore extends entirely through said noodle.

3. The combination of claim 1, wherein the flexible strands or tails are attached to the inside of said plug.

4. The combination of claim 3, wherein 8-16 flexible strands or tails are provided at each end.

5. The combination of claim 4, wherein the flexible strands or tails are of different colors.

6. The combination of claim 4, wherein the flexible strands or tails are individual hollow cylinders.

7. The combination of claim 1, wherein the first and second holders have an outer surface having threads formed thereon, and the first and second holders are secured in the axial bore of the noodle by the threads engaging with an inner surface of the axial bore.

* * * * *